United States Patent [19]

Wedel

[11] Patent Number: 4,905,379

[45] Date of Patent: Mar. 6, 1990

[54] INTERMEDIATE VACUUM ROLL FOR DRYER

[75] Inventor: Gregory L. Wedel, Beloit, Wis.

[73] Assignee: Beloit Corporation, Beloit, Wis.

[21] Appl. No.: 244,774

[22] Filed: Sep. 14, 1988

Related U.S. Application Data

[63] Continuation of Ser. No. 14,569, Feb. 13, 1987.

[51] Int. Cl.[4] ..... F26B 5/04

[52] U.S. Cl. ..... 34/16; 34/23; 34/115; 34/118

[58] Field of Search ..... 34/116, 117, 23, 120, 34/115, 16; 162/192, 368, 370, 371, 360.1

[56] References Cited

U.S. PATENT DOCUMENTS

| | | | |
|---|---|---|---|
| 2,714,342 | 8/1955 | Beachler | 162/370 |
| 2,959,222 | 11/1960 | Hornbostel | 162/360.1 |
| 3,110,617 | 11/1963 | Gottwald et al. | 34/116 X |
| 3,395,073 | 7/1968 | Davis, Jr. | 162/371 X |
| 4,483,083 | 11/1984 | Chance | 34/116 X |

*Primary Examiner*—Henry A. Bennett
*Assistant Examiner*—John Sollecto
*Attorney, Agent, or Firm*—Dirk J. Veneman; Raymond W. Campbell; David J. Archer

[57] ABSTRACT

A single tier dryer section apparatus is disclosed for drying a web extending through a paper machine. The apparatus includes a first dryer and a dryer felt extending around the first dryer such that the web is disposed between the felt and the first dryer for drying the web. A vacuum transfer roll is disposed downstream relative to the first dryer such that the web and felt extend contiguously from the first dryer to and around the transfer roll so that the felt is disposed between the web and the roll during transit of the web and felt around the roll. A second dryer is disposed downstream relative to the transfer roll such that the web and the felt extend contiguously from the transfer roll to and around the second dryer so that the web is disposed between the felt and the second dryer during transit of the web and the felt around the second dryer. The transfer roll includes a perforate shell such that when the roll is connected to a source of partial vacuum, a partial vacuum is generated within the shell for urging the web into close conformity with the felt and towards the perforate shell. The transfer roll is also movable from a first location to a second location. The first location is closely adjacent to the dryers so that the partial vacuum urges the web into conformity with the felt for inhibiting fluttering of the web. The second location is farther away from the dryers than the first location so that damage to the first dryer and the roll in the event of the web wrapping around the first dryer is inhibited.

11 Claims, 2 Drawing Sheets

FIG. 4
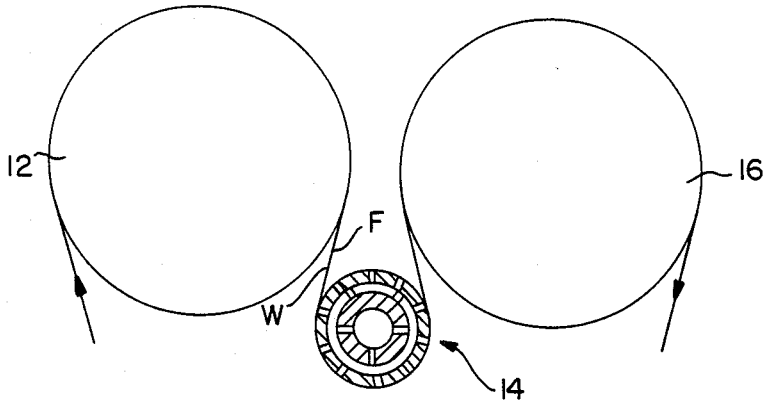
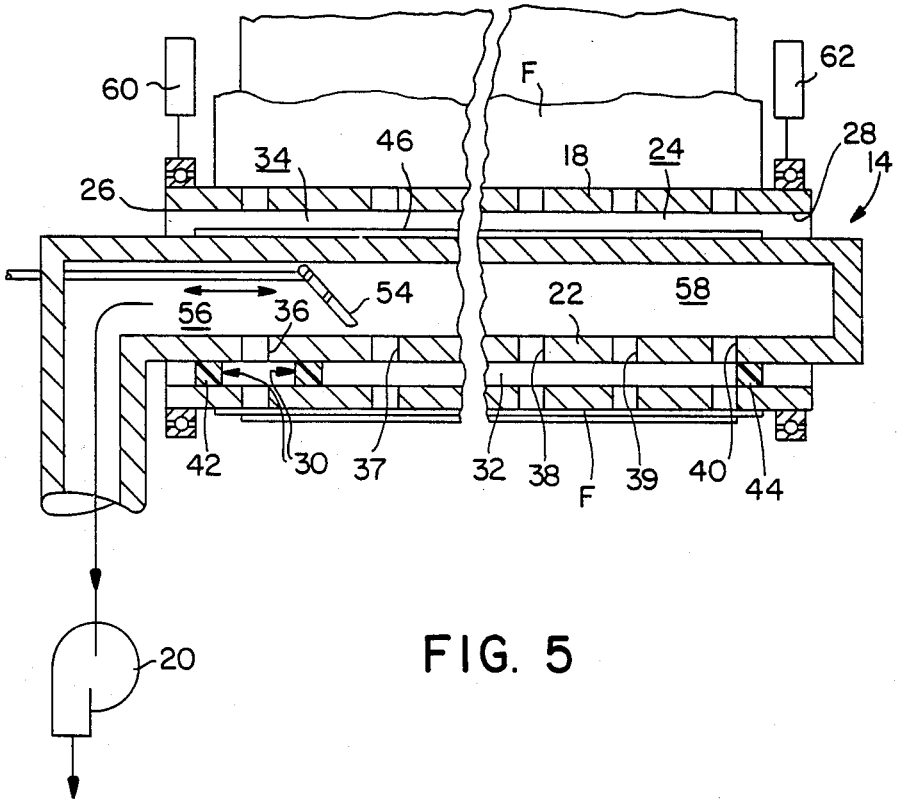
FIG. 5

INTERMEDIATE VACUUM ROLL FOR DRYER

CROSS-REFERENCE TO RELATED APPLICATION

The present application is a continuation in part of co-pending patent application Ser. No. 014,569 filed Feb. 13, 1987. All of the subject matter of Ser. No. 014,569 pending is incorporated herein by reference.

BACKGROUND OF THE INVENTION

1. FIELD OF THE INVENTION

The present invention relates to a single tier dryer section apparatus for drying a web extending through a paper machine. More particularly, the present invention relates to a Total BelRun dryer system wherein the transfer roll is a vacuum roll.

INFORMATION DISCLOSURE STATEMENT

Co-pending patent application Ser. No. 014,569 pending filed Feb. 13, 1987 discloses a Total BelRun configuration. Total BelRun is a registered trademark of Beloit Corporation.

In the Total BelRun drying concept, a web to be dried extends contiguously with a dryer felt alternately around successive dryers and vacuum transfer rolls.

Although the aforementioned Total BelRun configuration provides complete support for the web during transit through the dryer section, such Total BelRun configuration still maintains a certain span between each dryer and associated vacuum transfer roll. As the joint run of the web and felt extends through this span from the dryer to the vacuum transfer roll, there exists a tendency at high speed for the web, and especially the edges thereof to separate slightly from the supporting felt. Such separation is occasioned to a large degree by a pumping effect in the vicinity of the in-going nip defined by the felt and the transfer roll. The increased air pressure at such in-going nip tends to blow the web away from the support felt.

Although various blow box and vacuum box arrangements have been proposed as exemplified in U.S. Pat. Nos. 4,502,231, 4,359,828, 4,553,340, 4,441,263 and 4,516,330, the aforementioned blow boxes, if operated at sufficient capacity to prevent sheet flutter, have the tendency to draw the felt into physical contact with the associated box.

The present invention overcomes the aforementioned problem by moving the vacuum transfer roll towards the adjacent dryers so that an extremely small draw exists between the dryers and the vacuum transfer roll. By the provision of suitable seals, the partial vacuum generated within the vacuum transfer roll is operative in the vicinity of the aforementioned in-going and out-going nips and a sufficiently high vacuum level can be applied within the vacuum roll in order to inhibit fluttering of the web relative to the supporting felt.

Additionally, by means of the present invention, the vacuum transfer roll is provided with means for quickly moving the transfer roll away from the dryers in the event of web breakage so that if the web wraps around the dryer, damage to such dryer and associated transfer roll is prevented.

Therefore, it is a primary object of the present invention to provide a single tier dryer section apparatus that overcomes the inadequacies of the prior art arrangements and which provides a significant contribution to the paper drying art.

Other objects and advantages of the present invention will be apparent to those skilled in the art by a consideration of the detailed description contained hereinafter taking in conjunction with the annexed drawings and as defined by the appended claims.

SUMMARY OF THE INVENTION

The present invention relates to a single tier dryer section apparatus and method for drying a web extending through a paper machine. The apparatus includes a first dryer of the dryer section and a dryer felt which extends around the first dryer such that the web is disposed between the felt and the first dryer for drying the web. A vacuum transfer roll is disposed downstream relative to the first dryer such that the web and the felt extend contiguously from the first dryer to and around the transfer roll so that the felt is disposed between the web and the roll during transit of the web and felt around the roll. A second dryer is disposed downstream relative to the transfer roll such that the web and the felt extend contiguously from the transfer roll to and around the second dryer so that the web is disposed between the felt and the second dryer during transit of the web and felt around the second dryer. The transfer roll includes a perforate shell such that when the roll is connected to a source of partial vacuum, a partial vacuum is generated within the shell, the partial vacuum urging the web into close conformity with the felt and towards the perforate shell. The transfer roll is movable from a first location to a second location thereof. The first location is closely adjacent to the dryers such that the partial vacuum urges the web moving between the dryers and the transfer roll into close conformity with the felt so that separation of the web from the felt during transit between the dryers is inhibited. The second location of the transfer roll is further away from the dryers than the first location such that damage to the first dryer and the roll in the event of the web winding around the first dryer or the second dryer is inhibited.

In a specific embodiment of the present invention, a first dryer is top felted and the transfer roll also includes a stationary duct which is connected to the source of partial vacuum. The duct is disposed within the shell and the shell and duct define therebetween a chamber having a first and a second end thereof.

Seal means are disposed between the duct and the shell such that the seal means divides the chamber into a first and a second cavity. Each of the cavities extends from the first to the second ends of the chamber. The first cavity is of elongate C-shaped configuration and extends around the duct from an in-going nip defined by the felt and the roll to an out-going nip defined by the felt and the roll when the felt and web diverge relative to the roll. The first cavity is in fluid communication with the partial vacuum for urging the web into close conformity with the felt.

More particularly, the duct is coaxial relative to the shell, the duct defining a plurality of holes which extend through the duct to the first cavity.

The seal means includes a first C-shaped portion which is disposed adjacent to the first end of the chamber and which extends around the duct from the in-going to the out-going nip. The seal means also includes a second C-shaped portion which is disposed adjacent to the second end of the chamber and which extends around the duct from the in-going to the out-going nip.

First and second axial portions extend axially from the first to the second C-shaped portions adjacent to respectively the in-going and out-going nips such that the first and second C-shaped portions and the first and second axial portions cooperate together for dividing the chamber into the first and second cavities.

The angle defined by the C-shaped portions is greater than the angle defined by the web and felt during transit around the roll such that the partial vacuum within the first cavity is operative in the vicinity of the in-going and out-going nips for urging the web into close conformity with the felt in the vicinity of the nips.

More particularly, the duct also includes a damper which is disposed adjacent to the first end of the chamber. The damper is movable from a first position to a second position thereof such that when the damper is in the first position, the duct is divided into a first and a second enclosure so that the partial vacuum is concentrated within the first enclosure adjacent to the first end of the chamber for facilitating threading of a tail of the web.

The transfer roll also includes means such as quick-acting air cylinders for moving the roll from a first to a second location away from the dryers while maintaining the roll parallel to the first and second dryers.

Many modifications and variations of the present invention will be readily apparent to those skilled in the art by a consideration of the detailed description contained hereinafter. However, such modifications and variations fall within the spirit and scope of the present invention as defined by the appended claims.

Included in such modifications would be the provision of a non-movable vacuum roll disposed within the range ½-1 inch from the first dryer in order to inhibit fluttering of the web relative to the felt, the distance between the vacuum roll and the second dryer being greater than the distance between the roll and the first dryer.

BRIEF DESCRIPTION OF THE DRAWINGS

FIG. 4 is a side-elevational view of the dryer section apparatus shown in FIG. 1 but with the vacuum roll in the retracted second location thereof; and FIG. 5 is a sectional view similar to that shown in FIG. 3 but shows the damper in the opened second position thereof for inhibiting fluttering of the web relative to the felt.

DETAILED DESCRIPTION OF THE DRAWINGS

Figure 1:
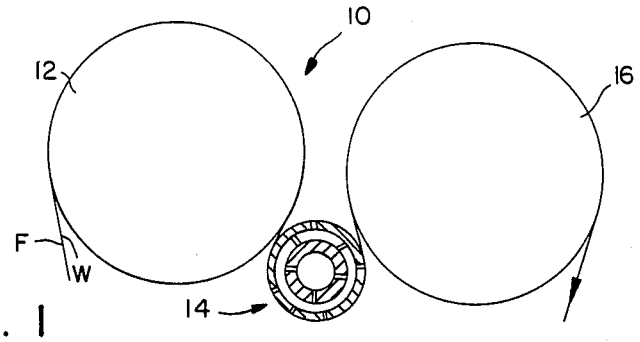
FIG. 1 is a side-elevational view of a single tier dryer section apparatus according to the present invention showing the transfer roll in the operative first location thereof.

FIG. 1 is a side-elevational view of a single tier dryer apparatus generally designated 10 according to the present invention. The apparatus 10 includes a first dryer 12 of the dryer apparatus 10. A dryer felt F extends around the first dryer 12 such that a web W is disposed between the felt F and the first dryer 12 for drying the web W.

A vacuum transfer roll generally designated 14 is disposed downstream relative to the first dryer 12 such that the web W and the felt F extend contiguously from the first dryer 12 to an around the transfer roll 14 so that the felt F is disposed between the web W and the roll 14 during transit of the web W and felt F around the roll 14.

A second dryer 16 is disposed downstream relative to the transfer roll 14 such that the web W and the felt F extend contiguously from the transfer roll 14 to and around the second dryer 16 so that the web W is disposed between the felt F and the second dryer 16 during transit of the web W and the felt F around the second dryer 16.

Figure 2:
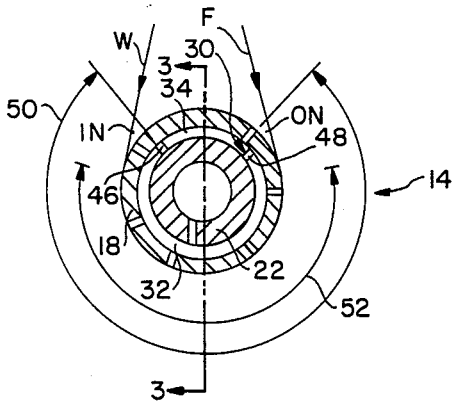
FIG. 2 is an enlarged sectional view of the vacuum transfer roll showing the web and felt extending around the shell of the transfer roll and the disposition of the seal means.
Figure 3:
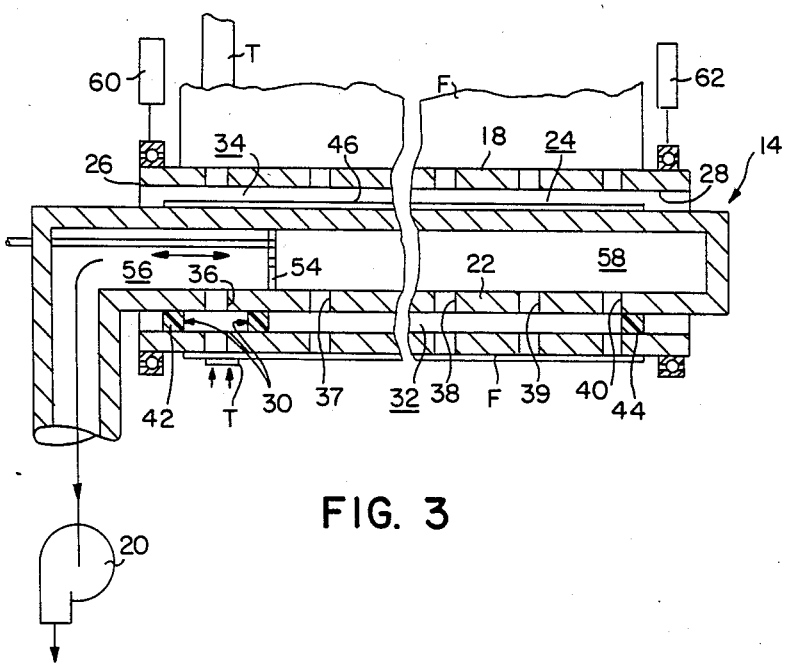
FIG. 3 is a sectional view of the transfer roll taken on the line 3—3 of FIG. 2 and shows the duct and the damper in the first position.

As shown in FIGS. 2 and 3, the transfer roll 14 includes a perforate shell 18 such that when the roll 14 is connected to a source of partial vacuum 20, a partial vacuum is generated within the shell 18. The partial vacuum urges the web W into close conformity with the felt F and towards the perforate shell 18.

Transfer roll 14 is movable from a first location as shown in FIG. 1 to a second location as shown in FIG. 4. The first location is closely adjacent to particularly the first dryer 12 such that the partial vacuum urges the web W moving between the dryer 12 and the transfer roll 14 into close conformity with the felt F so that fluttering of the web W during transit between the dryers 12 and 16 is inhibited.

The second location as shown in FIG. 4 is further away from the dryer 12 than the first location as shown in FIG. 1 such that damage to the first dryer 12 and the roll 14 in the event of the web W winding around the first dryer 12 is inhibited.

As shown in FIG. 1, the first and the second dryers are top felted.

FIGS. 2 and 3 show in more detail the transfer roll 14. The roll 14 includes a stationary duct 22 connected to the source of partial vacuum 20. The duct 22 is disposed within the shell 18 so that the shell 18 and the duct 22 define therebetween a chamber generally designated 24 having a first and a second end 26 and 28 respectively.

Seal means generally designated 30 is disposed between the duct 22 and the shell 18 such that the seal means 30 divides the chamber 24 into a first and second cavity 32 and 34 respectively. Each of the cavities 32 and 34 respectively extend from the first end 26 of the chamber 24 to the second end 28 of the chamber 24. The first cavity 32 extends around the duct 22 from an in-going nip IN defined by the felt F and the shell 18 to an out-going nip ON defined by the felt F and the shell 18 when the felt F and web W diverge relative to the roll 14. The first cavity 32 is of an elongated C-shape configuration and is in communication with the duct 22 such that the partial vacuum 20 is operative through the first cavity 32 for urging the web W into close conformity with the felt F.

The duct 22 is coaxial relative to the shell 18 and the duct 22 defines a plurality of holes 36, 37, 38, 39 and 40 which extend through the duct 22 to the first cavity 32.

The seal means 30 includes a first C-shaped portion 42 disposed adjacent to the first end 26 of the chamber 24. The portion 42 extends circumferentially around the duct 22 from the in-going nip IN to the out-going nip ON.

A second C-shaped portion 44 shown in FIG. 3 is disposed adjacent to the second end 28 of the chamber 24 and extends circumferentially around the duct 22 from the in-going nip IN to the out-going nip ON.

A first axial portion 46 of the seal shown in FIGS. 2 and 3 extends axially from the first C-shaped portion 42 to the second C-shaped portion 44 adjacent to the in-going nip IN.

A second axial portion of the seal 48 shown in FIG. 2 extends axially from the first C-shaped portion 42 to the second C-shaped portion 44 adjacent to the out-going nip ON such that the first and second C-shaped portions 42 and 44 respectively and the first and second axial portions 46 and 48 respectively cooperate together for dividing the chamber 24 into the first and second cavities 32 and 34.

The C-shaped portions 42 and 44 respectively define an angle indicated by arrow 50 shown in FIG. 2 which is greater than the angle indicated by arrow 52 shown in FIG. 2 defined by the web and felt W and F respectively during transit around the roll 14 such that the partial vacuum is operative in the vicinity of the in-going nip IN and the out-going nip ON for urging the web W into conformity with the felt F in the vicinity of the critical areas of the nips IN and ON respectively.

The duct 22 also includes a damper 54 which is disposed adjacent to the first end 26 of the chamber 24. The damper 26 is movable from a first position shown in FIG. 3 to a second position shown in FIG. 5 such that when the damper is in a closed first position as shown in FIG. 3, the duct 22 is divided into a first and second enclosure 56 and 58 respectively so that the partial vacuum is concentrated within the first enclosure 56 adjacent to the first end 26 of the chamber 24 for facilitating threading of a tail T of the web W.

When the damper 26 is disposed in the open second position thereof, as shown in FIG. 5, the partial vacuum is operative along the length of the duct 22 for inhibiting fluttering of the web relative to the felt and for generating an air flow from the nips IN and ON into the cavity 32.

The transfer roll also includes air cylinders 60 and 62 shown in FIGS. 3 and 5 for moving the roll 14 from the first location shown in FIG. 1 to the second location shown in FIG. 4 while maintaining the roll 14 parallel to the dryers 12 and 16 respectively.

Alternatively, the air cylinders 60 and 62 could be replaced by air bags, mechanical jacks or eccentric cams or the like.

In operation of the apparatus according to the present invention, the damper 54 is moved to the first position shown in FIG. 3 to concentrate the vacuum level within the first enclosure 56 so that the tail T of the web W may be easily threaded through the apparatus 10 without the need of threading ropes, using suitable air nozzles to direct the tail into direct contact with the vacuum of enclosure 56.

When the tail has been threaded, the damper 54 is moved to the second position thereof shown in FIG. 5 so that the vacuum level within the first cavity 56 is equal to the vacuum level within the second cavity 58 so that the web W is urged into close conformity with the felt thereby inhibiting fluttering of the web W relative to the supporting felt F when the tail has been widened to a full width web as shown in FIG. 5.

In the event of web breakage, the transfer roll 14 is moved from the first location shown in FIG. 1 to the second location shown in FIG. 4 so that if the web begins to wrap around the first dryer 12, damage to the first dryer 12 and closely adjacent transfer roll 14 is inhibited.

The present invention provides an extremely small draw between the dryers and the transfer roll while permitting the transfer roll to be moved away from the dryers in the event of a web breakage.

What is claimed:

1. A single tier dryer section apparatus for drying a web extending through a paper machine, said apparatus comprising:

a first dryer of said dryer section;

a dryer felt extending around said first dryer such that the web is disposed between said felt and said first dryer for drying the web;

a vacuum transfer roll disposed downstream relative to said first dryer such that the web and said felt extend contiguously from said first dryer to and around said transfer roll so that said felt is disposed between the web and said roll during transit of the web and felt around said roll;

a second dryer disposed downstream relative to said transfer roll such that the web and said felt extend contiguously from said transfer roll to and around said second dryer so that the web is disposed between said felt and said second dryer during transit of the web and felt around said second dryer;

said transfer roll including:

a rotatable perforate shell such that when said roll is connected to a source of partial vacuum, a partial vacuum is generated within said shell, said partial vacuum urging the web into close conformity with said felt and towards said perforate shell; and said transfer roll being movable from a first location to a second location thereof, said first location being closely adjacent to and spaced relative to said first dryer such that said partial vacuum urges the web moving between said dryers and said transfer roll into close conformity with said felt so that fluttering of the web during transit between said dryers is inhibited, said second location being further away from said dryers than said first location such that damage to said first dryer and said roll in the event of the web wrapping around said first dryer is inhibited.

2. An apparatus as set forth in claim 1 wherein said first dryer is top felted.

3. An apparatus as set forth in claim 1 wherein said transfer roll further includes:

a stationary duct connected to said source of partial vacuum, said duct being disposed within said shell, said shell and duct defining therebetween a chamber having a first and a second end thereof;

seal means disposed between said duct and said shell, such that said seal means divides said chamber into a first and a second cavity, both of said cavities extending from said first to said second ends of said chamber, said first cavity extending around said duct from an in-going nip defined by said felt and said roll to an out-going nip defined by said felt and said roll when said felt and web diverge relative to said roll, said first cavity being in communication with said duct such that said partial vacuum is operative through said first cavity for urging the web into close conformity with said felt.

4. An apparatus as set forth in claim 3 wherein said duct is coaxial relative to said shell, said duct defining a plurality of holes extending through said duct to said first cavity.

5. An apparatus as set forth in claim 4 wherein said seal means includes:

a first C-shaped portion disposed adjacent to said first end of said chamber, said first C-shaped portion extending from said in-going to said out-going nip;

a second C-shaped portion disposed adjacent to said second end of said chamber, said second C-shaped portion extending from said in-going to said out-going nip;

a first axial portion extending axially from said first to said second C-shaped portion adjacent to said in-going nip;

a second axial portion extending axially from said first to said second C-shaped portion adjacent to said out-going nip such that said first and second C-shaped portions and said first and second axial portions cooperate together for dividing said chamber into said first and second cavities.

6. An apparatus as set forth in claim 5 wherein said C-shaped portions define an angle which is greater than the angle defined by the web and felt during transit around the said roll such that said partial vacuum is operative in the vicinity of said in-going and out-going nips for urging the web into close conformity with said felt in said vicinity of said nips.

7. An apparatus as set forth in claim 3 wherein said duct further includes:

a damper disposed adjacent to said first end of said chamber, said damper being movable from a first position to a second position such that when said damper is in said first position, said duct is divided into a first and a second enclosure so that said partial vacuum is concentrated within said first enclosure adjacent to said first end of said chamber for facilitating threading of a tail of the web.

8. An apparatus as set forth in claim 1 wherein said transfer roll further includes:

means for moving said roll from said first to said second location while maintaining said roll parallel to said dryers.

9. An apparatus as set forth in claim 8 wherein said means for moving said roll includes a first and second air cylinder.

10. An apparatus as set forth in claim 1 wherein said first dryer is bottom felted.

11. A method for drying a web extending through a single tier dryer section apparatus, said method comprising the steps of:

guiding the web and a dryer felt around a first dryer such that the web is disposed between the felt and the first dryer for drying the web;

guiding the web and felt contiguously from the first dryer to a vacuum transfer roll disposed downstream relative to the first dryer such that the web and felt extend around the transfer roll with the felt disposed between the web and the roll during transit of the web and felt around the roll;

thereafter guiding the web and felt contiguously from the roll to and around a second dryer disposed downstream relative to the roll such that the web is disposed between the felt and the second dryer during transit of the web and felt around the second dryer;

connecting the roll to a source of partial vacuum so that a partial vacuum is generated within a rotatable perforate shell of the roll such that the web is urged into close conformity with the felt during movement of the web and felt around the perforate shell; and moving the roll from a first to a second location thereof in the event of a web breakage, the second location being farther away from the first dryer than the first location such that in the second location of the roll, in the event of the web wrapping around the first dryer, damage to the first dryer and the roll is inhibited.

* * * * *